US007969033B2

(12) United States Patent
Ryan

(10) Patent No.: US 7,969,033 B2
(45) Date of Patent: Jun. 28, 2011

(54) BUOYANCY ENERGY CELL

(76) Inventor: James Ryan, North Palm Beach, FL (US)

( * ) Notice: Subject to any disclaimer, the term of this patent is extended or adjusted under 35 U.S.C. 154(b) by 230 days.

(21) Appl. No.: 12/463,193

(22) Filed: May 8, 2009

(65) Prior Publication Data

US 2010/0283261 A1 Nov. 11, 2010

(51) Int. Cl.
*F04B 35/00* (2006.01)

(52) U.S. Cl. ..... 290/53; 290/42; 60/495; 60/496; 60/497; 417/330; 417/331; 417/333

(58) Field of Classification Search ..... 290/42, 290/53, 1 R; 60/495–498, 501, 504, 500, 60/502, 505, 398, 507; 416/7
See application file for complete search history.

(56) References Cited

U.S. PATENT DOCUMENTS

| | | | | |
|---|---|---|---|---|
| 1,403,702 | A * | 1/1922 | Melvin | 60/496 |
| 3,668,412 | A | 6/1972 | Vrana et al. | |
| 3,959,663 | A * | 5/1976 | Rusby | 290/53 |
| 4,208,878 | A * | 6/1980 | Rainey | 60/496 |
| 4,627,240 | A | 12/1986 | Holmes | |
| 6,009,707 | A | 1/2000 | Alkhamis | |
| 6,964,165 | B2 * | 11/2005 | Uhl et al. | 60/495 |
| 7,012,341 | B2 | 3/2006 | Matsubara | |
| 2008/0000224 | A1 * | 1/2008 | Swart | 60/497 |
| 2008/0016863 | A1 | 1/2008 | Tai et al. | |
| 2008/0264056 | A1 * | 10/2008 | Tung | 60/496 |

FOREIGN PATENT DOCUMENTS

| | | |
|---|---|---|
| GB | 2052007 | 1/1981 |

* cited by examiner

*Primary Examiner* — Tho D Ta
(74) *Attorney, Agent, or Firm* — McHale & Slavin, P.A.

(57) ABSTRACT

A device for the generation of energy and in particular electrical energy includes a cell or chamber which moves upwardly and downwardly in a body of water. Cog wheels are connected to the cell. The cog wheels are connected to the shafts of generators. Rotation of the cog wheels operates the generators which produce energy. The cog wheels engage anchor chains or vertical supports. One end of each anchor chain is secured to an anchor located at the bottom of the body of water. The other end of the anchor chain is secured to a float which floats at or near the surface of the body of water. The up and down movement of the cell causes the cog wheels to move upwardly and downwardly along the anchor chains and thereby rotate. This rotation drives the energy generator and generates energy, preferably electricity. The cog wheels are permitted to rotate upon the receipt of a request for energy. This results in a highly efficient source of energy or electricity.

16 Claims, 2 Drawing Sheets

BUOYANCY ENERGY CELL

FIELD OF THE INVENTION

The present invention relates to energy generation and more particularly to electrical power generation devices or equipment. The electrical generation device includes a container or tank positioned within a body of water. Water is introduced into and evacuated from the container or tank resulting in the container floating or sinking in the body or water. The upward and downward movement of the container operates equipment which in turn generates electrical power.

BACKGROUND OF THE INVENTION

Electrical power generation utilizing hydraulic equipment, thermal equipment and nuclear equipment has been known for many years. The use of thermal equipment, such as coal-fired, oil-fired and natural gas-fired power plants, to generate electrical power has become very wide spread in today's world. The use of nuclear power generators, while in use in many different countries, has significantly decreased within the United States due to concerns regarding the danger of exposure to nuclear radiation from the plant. These power generation systems suffer from many similar problems, mainly destruction of the environment and pollution of the environment by the waste products they generate.

In the past electrical power generation was achieved by utilizing hydroelectric power generation plants located within dams. The initial cost of building these plants lead to the use of thermal equipment to generate electrical power. Also, the reduced water flow in certain rivers has not enabled some of these hydroelectric power plants to operate at or near capacity.

There has recently been some interest in the generation of electrical power utilizing wave motion in the ocean or underwater currents in the ocean. However, to date these techniques have been very inefficient and very costly. Also, there has been a growing interest in generation of electric power utilizing solar energy. This has so far proven to be very expensive. Finally, the use of wind to generate electrical power is very old but not widely used. More efficient wind turbines are being developed to reduce the cost of generation of electrical power utilizing the wind.

None of the above noted electrical power generators have yet proven to be both cost effective and non-polluting. One of the largest obstacles facing the use "clean energy" is that the energy is not available "on demand". Furthermore, there is no means presently available to match the output of clean energy to the demand. As a result, all clean energy not used as and when it is produced is lost. Thus, what is needed in the art is an electrical power storage device that is highly efficient, cost effective, non-polluting, scalable, relatively unrestricted as to its geographical location so that it can be located in various, numerous locations and supply electrical power on demand.

DESCRIPTION OF THE PRIOR ART

Holmes, U.S. Pat. No. 4,627,240 discloses a wave powered engine which includes a float 25 that rises and falls by variable buoyancy and which is guided by rails attached to the sea bed to restrict the motion of the float to vertical motion. The float having variable buoyancy and a depending skirt to increase the thrust of the float on upward and downward power strokes, and means on a framework fixed to the ocean bed that cooperates with means fixed to the movement of a shaft as a result of the reciprocating movement of the float. Racks are secured to the float and engage a pinion which in turn rotates a shaft. The shaft can be connected to a generator to generate electricity. While this patent teaches employing air and water to raise and lower a float which can be used to generate electricity, it does not disclose the electrical generators directly mounted on the float. Furthermore, it will generate little or no electricity when the seas are calm.

Matsubara, U.S. Pat. No. 7,012,341 discloses an electric power generator for generating electric power which comprises a floating member for floating on the surface of a body of water, such as a lake, a power generator installed on an upper surface of the floating member, a cage suspended from a lower end of the floating member and held to a water bottom, a pair of floating bodies 5 positioned in the cage, a wire rope whose both ends are fixed to the cage, and an air filling-up apparatus for filling up air to each of the floating bodies. The wire rope is wound on a pulley installed an end portion of each floating body and wound to a pulley installed on the power generator. Air or gas in introduced into each floating body when it is at the lower portion of the cage. This provides sufficient buoyancy to float the body toward the surface of the water. Upon reaching the surface, the air is released from the body and the body sinks toward the bottom of the cage. This up and down motion rotates the pulleys which are connected to electrical generator which in turn generates electricity. While this patent teaches employing air and water to raise and lower a float which can be used to generate electricity, it does not disclose the electrical generators directly mounted on the float. Further, it does not disclose the use of water pumps to empty the floating bodies. Also, pumping air into a submerged vessel is far less efficient, from an energy standpoint, than pumping water out of the same vessel.

Alkhamis, U.S. Pat. No. 6,009,707 discloses device for generating energy from a source of pressurized fluid by harnessing buoyancy and gravitational forces. The device includes one container which has an inlet port on its top side for receiving fluid or water while the container is at the top of a tank. A drainage port on a bottom side of the container is for draining the fluid when the container is at the bottom of the tank and an air port is for introducing air into the tank. A chain belt is attached to the container such that the chain belt rotates as the container travels upwardly and downwardly and a shaft connected to the chain belt for producing rotational energy by generator, FIG. 1. While this patent teaches employing air and water to raise and lower a float which can be used to generate electricity, it does not disclose the electrical generators directly mounted on the float nor the use of water pumps to empty the float. Also, this patent does not demonstrate a practical means of pressurizing the fluid nor disclose how such pressurized fluid is drained from the submerged container.

Short, UK Patent Application No. UK2052007 discloses an open-ended container immersed in water with its open end directed downwardly with a closable vent. A weight is provided such that when the container is filled with water the effective weight causes the container to sink. Compressed air is supplied through a pipe with the vent closed causes the container to float upwardly until the vent is opened. This releases the air and allows the container to sink. Thus, a reciprocating movement of the container is obtained and is converted, by selective engagement of a pinion with teeth, to rotation always in the one direction of the pinion and therefrom to an output shaft. However, there is no disclosure of generation of electricity.

Vrana et al., U.S. Pat. No. 3,668,412 discloses an apparatus for harnessing the vertical movement of ocean tides and utilize the force for generating electrical energy. The apparatus is based on the principal of a large float which exerts force upwardly at a time of a rising tide and a downward force due to gravity at a time of a falling tide, the float is first securely captivated to the level of the prevailing low tide and is then released at the height of the tide in order to contribute its full built up force of available energy. The vertical movements of the float are transmitted from a vertical superstructure mounted upon the float to a rotatable gear mounted upon a rotatable horizontal shaft journalled in stationary stanchions, and the rotatable shaft thus driving an electrical generator or performing other useful work. Alternatively, movement of sea water through a duct turns a turbine wheel and operates an electrical generator. This device does not utilize air to change the buoyancy of a tank or float.

Tai et al., U.S. Published Patent Application No. 2008/0016863 discloses a wave energy power generating apparatus which includes a fixed base, a buoyant float unit and at least one gearing mechanism. The fixed base has a slide shaft mounted thereon for connecting with the buoyant float unit. The buoyant float unit includes a buoyant float slidably connected with the slide shaft, and at least one rack mechanism formed with a pair of rack members. The gearing mechanism includes a transmission shaft, and a pair of one-way gears connected with the transmission shaft and engaged with the rack members. The rack members can drive the one-way gears to rotate the transmission shaft in a single predetermined direction when an upward or downward movement of the buoyant float unit occurs. While this patent does not specifically mention the generation of electricity it does mention the use of a generator set. This device does not utilize air to change the buoyancy of a tank or float but rather relies on ocean wave motion.

SUMMARY OF THE INVENTION

A device for the storage and generation of energy and in particular electrical energy includes a cell or chamber which moves upwardly and downwardly in a body of water. Cog wheels are connected to the cell. The cog wheels are connected to the shafts of generators. Rotation of the cog wheels operates the generators which produce energy. The cog wheels engage anchor chains or vertical supports. One end of each anchor chain is secured to an anchor located at the bottom of the body of water. The other end of the anchor chain is secured to a float which floats at or near the surface of the body of water. The up and down movement of the cell causes the cog wheels to move upwardly and downwardly along the anchor chains and thereby rotate. This rotation drives the energy generator and generates energy, preferably electricity. The cog wheels are permitted to rotate upon the receipt of a request for energy. This results in a highly efficient source of energy or electricity.

Accordingly, it is an objective of the instant invention to provide a device which moves upwardly and downwardly in a body of water, in a controlled manner, to produce energy on demand.

It is a further objective of the instant invention to employ a pump or pumps to remove the water from a container and permit the container to fill with air or a gas through a snorkel or tube connected to the atmosphere or a source of gas, thus making the container buoyant within a body of water and permitting the device to float upwardly within the body of water upon release of a locking mechanism, which holds the container under the body of water.

It is yet another objective of the instant invention to displace a gas within a container and permit the container to sink within a body of water.

It is a still further objective of the instant invention to provide a device with a plurality of rotary devices which operate energy generators in response to upward and downward movement of a container within a body of water.

It is still yet another object of the instant invention to provide a device and method for storing energy produced by clean energy devices which utilize wind, waves, tidal motion, water currents, or such in an equally ecological friendly manner so that the energy produced by these devices can efficiently stored and be released for use on demand.

It is still a further objective of the instant invention to provide a device for producing and storing energy which can be constructed in various sizes which could be determined by the demand for the energy, It is still a further objective of the instant invention to provide a device for producing energy which can be installed behind a dam or in lakes, oceans, large and small bodies of water, within buildings, etc.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
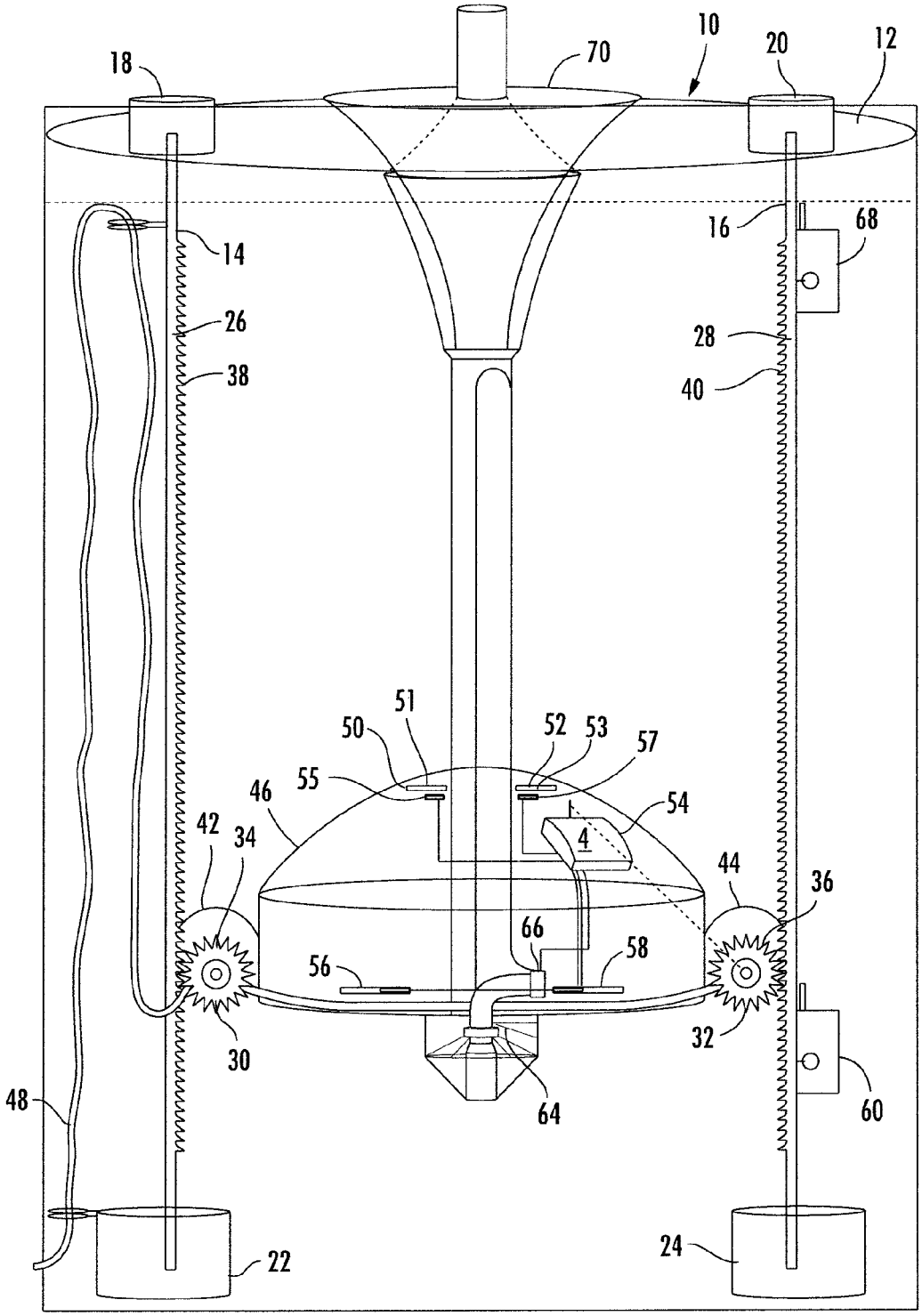
FIG. 1 is an elevated view of the present invention in a body of water.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 2:
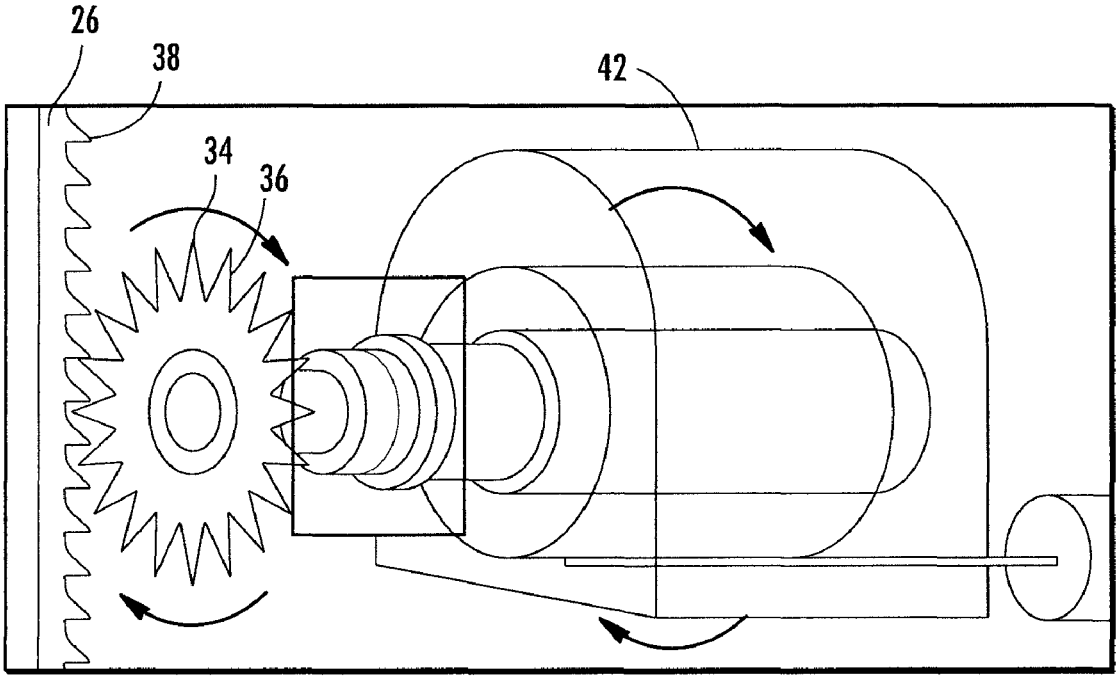
FIG. 2 is a front perspective view of an electrical generator of the present invention.

A first preferred embodiment of the present invention is illustrated in FIGS. 1-2. In this embodiment an energy producing cell 10 is located within a body of water 12. The body of water may be a tank, a lake, a pond, an ocean, a river, etc. It can be a natural body of water or a man made body of water. Two anchoring chains or vertical guides 14 and 16 are vertically positioned within the body of water 12. While two anchor chains are illustrated, any number of anchor chains or vertical guides 14 can be employed. Floats, buoys or upper supports 18 and 20 are secured to one end of the chains 14 and 16 and float on the surface of the body of water. These floats position the upper portion of the chains in the vicinity of the upper portion of the body of water. While floats 18 and 20 are preferable, any other devices which position the upper end of chains 14 and 16 in the vicinity of the upper portion of a body of water can be employed, such as permanent structural members, ropes, chains, etc.

The lower end of chains 14 and 16 are secured to anchors or lower supports 22 and 24. The anchors 22 and 24 are positioned at the bottom of or in a lower portion of the body of water 12. The anchors can be secured to the bottom of the tank or body of water. They can also be moveable with respect to the bottom of the body of water and not secured to the bottom. Further, they can be in the vicinity of a lower portion of the body of water. The anchor 22 is preferably positioned directly below the float 18. A chain or vertical guide 26 is secured between anchor 22 and float 18 such that the chain is substantially vertical and taught. A similar chain 28 is secured between anchor 24 and float 20. It is also substantially vertical. While the chains 26 and 28 are illustrated as being substantially vertical, the upper can be in other positions between the upper and lower supports. For example the chains can be at a 15 degree angle, with respect to the vertical, or at other angles. The only criterion, regarding the deployment or position of the chains, is that the chains be substantially parallel to each other.

A cogwheel or rotary device 30 operatively engages chain 26. A second cogwheel or rotary device 32 operatively engages chain 28. The cog wheels are formed with cogs 34 on wheel 30 and cogs 36 on wheel 32. Cogs 34 preferably engage projections 38 on chain 26 and cogs 35 preferably engage projections 40 on chain 28. In place of projections 38 and 40, chains 26 and 28 can be provided with slots or spaces into which cogs 34 and 36 fit, thereby operatively engaging chains 26 and 28. While these are the preferably forms of operative engagement between the cog wheels and the chains, other structures or types of engagement between the cog wheels and chains can be employed as long as the cog wheels rotate as they travel up and down along the chains or other structures. While two chains are illustrated in a preferred embodiment, any number of chains can be employed.

Movement of the cog wheels up and down along the length of the chains is the result of the rising and sinking of the generators and container that the cog wheels are secured to. The preferred embodiment, illustrated in FIG. 1 illustrates two generators 42 and 44 secured to cog wheels 30 and 32 respectively. Generators 42 and 44 are also secured to opposite sides of a cell or container 46. The rising/floating and lowering/sinking of the cell causes the generators 42 and 44 to rise up or lower down respectively. This action causes the cog wheels 30, 32 to move up and down along chains 26 and 28 respectively. This in turn causes the cog wheels to rotate. The rotation of the cog wheels causes the generators to rotate and generate energy. The generators 42, 44 are preferably electrical generators and thus the raising and lowering of cell 46 generates electricity. The cog wheels 30, 32 can be locked to prevent their rotation.

The electricity or energy generated by the generators is delivered to a consumer (not shown) via a power line 48. The power line 48 is also connected between all of the generators. While two generators 42 and 44 are illustrated, any number of generators can be employed. The number and size of generators that are employed is dependent on the size of the buoyancy cell. Thus the larger the cell, the greater the amount of energy or electricity generated or produced.

A cell, tank or container 46 is positioned with in the body of water. Two or more electrical generators are secured to an outer perimeter of the cell 46. The interior of cell 46 is substantially hollow and fluid tight. The cell has vents 50, 52 located in a top portion of the cell. The vents 50, 52 permit the release of air or gas from the interior of the cell. The opening and closing of vents 50, 52 is controlled by a control device 54 positioned preferably on or within cell 46. The control device could also be positioned outside of the cell 46 and outside of the body of water. The control device is preferable a computer or processor. Preferably relative small floats, 51 and 53, within the cell close vents 50 and 52. Springs 55 and 57 open the vents 50 and 52. While two vents are illustrated, any number of vents can be employed.

Electrical power to operate the computer or processor 54 can be self contained by employing batteries or it can be obtained from external sources and delivered through cable 48. One or more water intake openings 56, 58 permit the introduction of water or other fluids into cell 46. The operation of water intake openings 56, 58 is controlled by computer 50, the floats 51, 53 and springs 55, 57 described herein above. The opening of water intakes 56, 58 permit the introduction of water or other fluids into cell 46. While two water intakes are illustrated, any number of water intakes can be employed.

Initially the cell 46 is positioned at the top or in the vicinity of an upper portion of a body of water. To begin the operation of the energy cell, water intakes 56 and 58 are opened. Air vents 50 and 52 are also opened. Air or gas is expelled from the interior of the cell 46 and it is displaced by water or other fluids. Cell 46 then begins to sink downwardly toward the bottom or lower portion of the body of water and thus is submerged in the body of water.

After the cell reaches a desired depth within the body of water, a first sensor 60 is activated. This sensor 60 sends a signal to control device 54 which closes air vents 50, 52, and water intakes 56, 58. A fluid pump 66 is located in a lower portion of the cell 46. Fluid pump 66 is also controlled by control device 54. While the control device is illustrated and being within the cell 46 and electrically connected to vents 50, 52 and openings 56 and 58, it could be located remote from the cell and operated the vents and openings via radio transmissions. Further the communications between the control device 54 and the sensors 60 and 66 can be via radio communications also.

After the cell sinks or is lowered down to the bottom of the body of water and the first sensor 60 is activated. This activation can occur through direct contact of the cell and the sensor 60 and/or by indirect contact between the cell and the sensor. Indirect contact can be achieved by the use of proximity sensors for example. Computer 54 detects activation of the sensor 60 and instructs valve 64 to open and activate the operation of pump 66. The computer 54 also locks the cog wheels and prevents their rotation. Upon receipt of a signal the cog wheels are unlocked and permitted to freely rotate. Pump 66 then pumps the water out of the interior of cell 46. Air or a gas is then introduced into the cell through snorkel 70 thus filling cell 46. When substantially all of the water or fluid is removed form the cell 46 and air replaces the water, the cell 46 becomes buoyant. Upon receipt of a signal the cog wheels are unlocked and permitted to freely rotate. This allows the cell 46 to float slowly to the surface of the body of water. Because the generation of electricity regulates the speed at which the cell ascends in the body of water, very little energy is lost due to friction. Thus energy or electricity is generated "on demand". In other words, only when the cog wheels are unlocked can the cell rise upwards and produce energy or electricity. Utilizing the instant invention permits the generation of energy only when there is a demand for the energy or electricity and thus no energy or electricity is wasted.

As the cell 46 rises upwards from the bottom of the body of water towards the top of the body of water, the cog wheels 30, 32 engage the chains or vertical supports 26, 28 and rotate. The cog wheels are connected to a shaft of the generators and the generators operate as a result of the cog wheels' rotation. The generators generate energy in response to the rotation of the shaft. In a preferred embodiment electrical energy is generated by the generators. The energy produced by the generators is delivered to a consumer or user via a power cable or cables 48. In the preferred embodiment, electricity is delivered from the electrical generators 42, 44 to consumers.

When the cell reaches an upper portion of the body of water it activates second sensor 68. This activation can occur through direct contact of the cell and the sensor 68 and/or by indirect contact between the cell and the sensor. Indirect contact can be achieved by the use of proximity sensors for example. Computer 54 detects activation of sensor 68 and instructs valve 64 to close, vents 52 and 54 to open and water intakes 56, 58 to open. This action releases the air or gas within the cell and allows the cell to fill with water or fluid and sink toward the bottom of the tank or body of water, thus submerging the cell 46 in the body of water again. The repeated raising and lowering of the cell 46 will continue to generate energy or electricity, thus resulting in a substantially constant source of energy or electricity.

The cog wheels may or may not engage the anchor chains or vertical guides as the cell sinks toward the bottom of the tank. In the situation where the cog wheels engage the chains, the turbines are activated and energy is generated. Preferably energy is generated when the cell rises. However, energy can be generated when the cell both rises and sinks.

As the snorkel or vent stack 70 is submerged it creates positive buoyancy as the momentum of cell 46 causes it to sink toward the bottom of the body or water beyond a position of neutral buoyancy. The positive buoyancy of the snorkel 70 further provides buoyancy of the device enabling the device to maintain a vertical buoyancy position while cell 46 is submerged near the bottom of the body of water.

In addition, when the energy producing cell is placed in a body of water that has a current, waves, or tidal movement, the motion created by these forces provide the energy necessary to pump the water out of cell 46. Other clean and/or more affordable energy sources could be utilized to operate the pump 66. For example, non-peak commercial electrical sources, wind, geothermal energy sources, hydro-electric power, etc.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A device to convert the rising and sinking of a container in a body of fluid to other forms of energy comprising:

substantially vertical guides positioned on a bottom of a body of fluid;

a container connected to and located between said substantially vertical guides, said container being substantially hollow;

a device introducing a gas into said container;

at least one opening communicating with said container and said body of fluid allowing said fluid to flow into said container;

a pump constructed and arranged to remove fluid contained within said container;

rotary devices operatively engaging said substantially vertical guides, said rotary devices being operatively connected to at least one energy generator;

said at least one energy generator being connected to said container;

said at least one energy generator and said rotary devices connecting said container to said substantially vertical guides;

a first sensor constructed and arranged to cause the activation of said pump and the introduction of said gas into said container when said container is at a first predetermined depth in said body of fluid; and a second sensor constructed and arranged to cause the release of said gas from said container and the introduction of fluid into said container when said container is at a second predetermined depth in said body of fluid, said second predetermined depth is at a greater distance from said bottom of said body of fluid than said first predetermined depth.

2. The device of claim 1 wherein said energy generator is an electrical generator; electrical conductors connected to at least one electrical generator, said electrical conductors delivering electrical energy from said electrical generators to a consumer of electrical energy.

3. The device of claim 1 wherein said container includes at least one vent positioned at an upper portion thereof, said at least one vent being operational to both retain gas in said container and release gas from said container.

4. The device of claim 1 wherein said container includes at least one fluid intake opening positioned at a lower portion of said container, said at least one fluid intake opening being operational to permit fluid to be introduced into said container, retain fluid in said container and release fluid from said container.

5. The device of claim 1 including a device which locks and prevents rotation of said rotary devices.

6. The device of claim 1 wherein said rotary devices are cog wheels, said cog wheels engage projections on said substantially vertical guides whereby when said container rises or sinks in said body of fluid said cog wheels turn in response to said container moving upward or downward along said substantially vertical guides, rotation of said cogwheels turn said energy generators and generate energy.

7. The device of claim 6 wherein said at least one energy generator is constructed and arranged to generate energy when said cog wheels are rotated in either a clockwise or counterclockwise direction.

8. The device of claim 3 wherein said container includes at least one fluid intake opening positioned at a lower portion of said container, said at least one fluid intake opening being operational to permit fluid to be introduced into said container, retain fluid in said container and release fluid from said container.

9. The device of claim 1 including a control device in communication with said first and said second sensors, said control device causing introduction of said gas into said container when said container is at a first predetermined depth in said body of water and the release of said gas from said container and the introduction of water into said container when said container is at a second predetermined depth in said body of water.

10. The device of claim 9 wherein said container includes at least one vent positioned at an upper portion thereof, said at least one vent being operational to both retain gas in said container and release gas from said container, said container includes at least one water intake opening positioned at a lower portion of said container, said at least one fluid intake opening being operational to permit fluid to be introduced into said container, retain fluid in said container and release fluid from said container, said control device is a computer, said control device controls the operation of said at least one vent as the operation of said at least one fluid intake.

11. The device of claim 1 wherein said pump being constructed and arranged to pump fluid contained within said container to an exterior of said container, thereby emptying said container of any fluid contained therein.

12. The device of claim 11 including a control device, said control device controlling the operation of said fluid pump, said control device controlling the device which locks and unlocks the rotation of said rotary devices.

13. The device of claim 12 wherein said control device unlocks the device which locks the rotation of said rotary devices upon receipt of a signal which indicates a demand for energy.

14. The device of claim 1 including a snorkel connected to said container, said snorkel being constructed and arranged to introduce said gas into said container and thus move said container upwardly and downwardly thereby operating said at least one energy generator.

15. The device of claim 10 including a snorkel connected to said container, said snorkel being constructed and arranged to introduce said gas into said container and thus move said container upwardly and downwardly thereby operating said at least one energy generator.

16. The device of claim 14 wherein said snorkel is constructed and arranged to float in said body of ware and maintain said container in a substantially upright position.

* * * * *